US007083485B2

(12) United States Patent
Melius

(10) Patent No.: US 7,083,485 B2
(45) Date of Patent: Aug. 1, 2006

(54) MULTIPLE-SERIAL-HYDROFOIL SWIM FINS

(76) Inventor: John David Melius, 2725 Vista Ct., Waldorf, MD (US) 20603

( * ) Notice: Subject to any disclaimer, the term of this patent is extended or adjusted under 35 U.S.C. 154(b) by 128 days.

(21) Appl. No.: 10/701,571

(22) Filed: Nov. 6, 2003

(65) Prior Publication Data

US 2005/0176316 A1 Aug. 11, 2005

(51) Int. Cl.
*A63B 31/08* (2006.01)

(52) U.S. Cl. ..... 441/64

(58) Field of Classification Search ..... 441/55, 441/60, 61, 64; D21/806
See application file for complete search history.

(56) References Cited

U.S. PATENT DOCUMENTS

| | | | | |
|---|---|---|---|---|
| 3,107,372 | A | 10/1963 | Brown et al. | |
| 4,944,703 | A | 7/1990 | Mosier | |
| 5,417,599 | A * | 5/1995 | Evans | 441/64 |
| 5,536,190 | A | 7/1996 | Althen | |
| 6,183,327 | B1 | 2/2001 | Meyer | |
| 6,322,411 | B1 * | 11/2001 | Evans | 441/64 |
| D455,188 | S * | 4/2002 | Evans | D21/806 |
| 6,620,008 | B1 | 9/2003 | Green | |

FOREIGN PATENT DOCUMENTS

WO WO 01/85266 A2 5/2001

OTHER PUBLICATIONS

Jeffrey A. Walker—Functional Morphology and Vitual Models: Physical Constraints on the Design of Oscillating Wings, Fins, Legs, and Feet at Intermediate Reynold Numbers American Zoologist; in Press.
Jeffrey A. Walker—Mechanical Performance of Aquatic Rowing and Flying—The Royal Society.
Internet Artical—Optimal Flapping Wing Cycle.
Internet Artical—Movement of a Dolphin Flipper-> Propulsive Hydrofoil.

* cited by examiner

*Primary Examiner*—Ed Swinehart

(57) ABSTRACT

MULTIPLE-SERIAL-HYDROFOIL swim fins use aerodynamic shapes to help with propulsion through the water. By producing "lift" as an additional power source for swimming, they provide more power for the swimmer without additional effort from the swimmer. The planar blade helps to provide self-regulating pitch for the hydrodynamic shapes. The overall reduction in the size and cost of the swim fin is a secondary benefit to the reduction in work for the swimmer. By having multiple self-regulating airfoils (hydrofoils when used in water) in a series properly distanced from one another, the accelerated flow of water over the hydrodynamic shapes increases the effectiveness of the trailing hydrodynamic shapes through serial amplification. The geometry of the swim fins work with high performance materials using sophisticated internal properties (compliant geometry) to manage the self-regulating pitch and serial amplification.

20 Claims, 6 Drawing Sheets

Figure 3
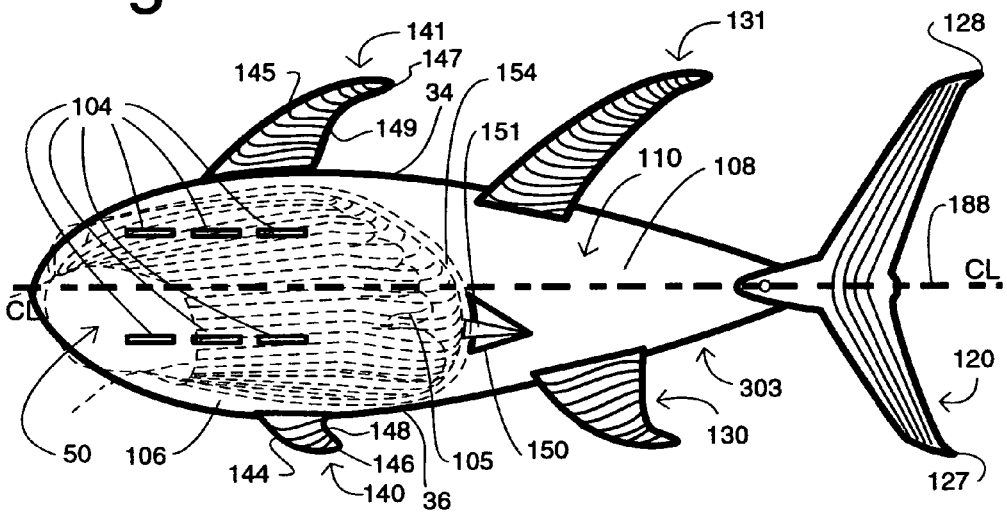
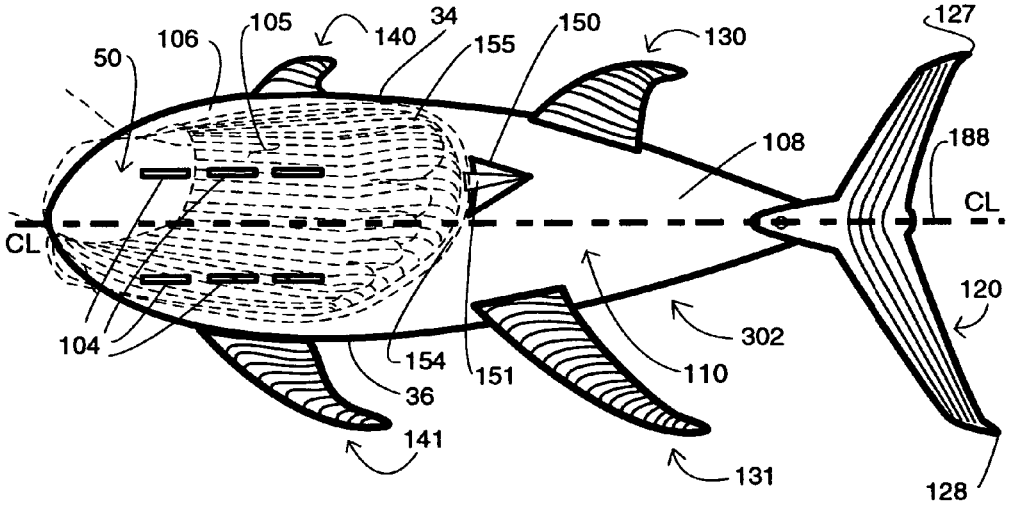
Figure 4

Figure 5
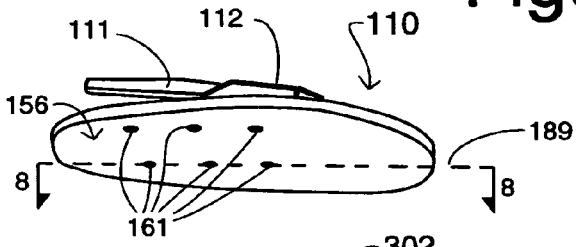
Figure 6
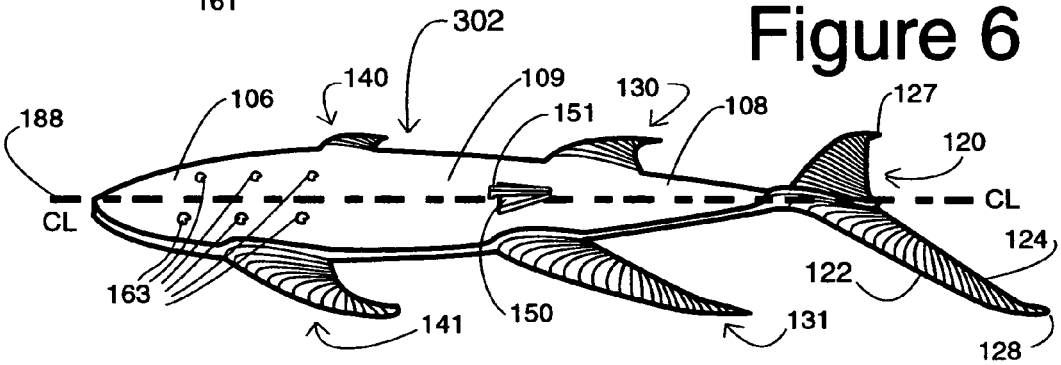
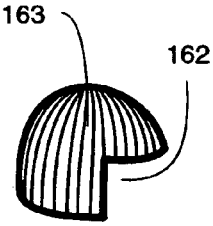
Figure 7
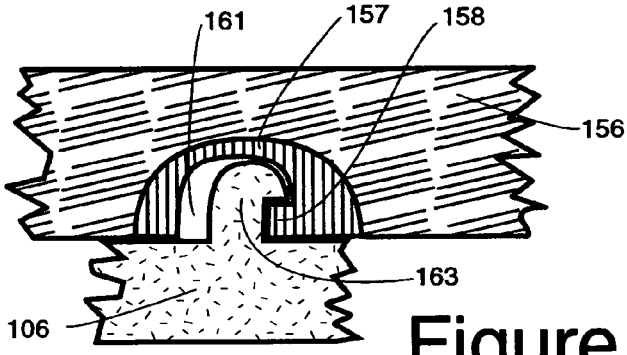
Figure 8
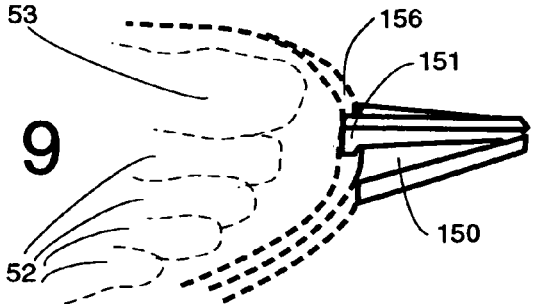
Figure 9

305
191
192
193
194
190
190A
190B
120
122
124
126
127
128
130
131
140
141
154
180
181
182
195
196
105
106
108
90
92
94
95
96
135
137
15
16

MULTIPLE-SERIAL-HYDROFOIL SWIM FINS

STATEMENT REGARDING FEDERALLY SPONSORED R&D

Not applicable

INCORPORATION-BY-REFERENCE OF MATERIAL SUBMITTED ON A COMPACT DISC

Not applicable

RELATED APPLICATIONS

This patent application relies on the filing date of U.S. provisional patent application Ser. No. 60/424,020 filed Nov. 6, 2002 for MULTIPLE HYDORFOILS FISH STYLE SWIM FIN, which application is incorporated herein by this reference thereto.

BACKGROUND

1. Field of Invention

This invention relates to swim fins and more particularly swim fins of an advanced design for swimming and diving at water level and below the water, and more particularly to swim fins employing aerodynamic shapes (hydrodynamic shapes when used in water) attached to the sides of a planar blade and employing an aerodynamic shaped tail fin. By having multiple hydrodynamic shapes in a series with a set distance from one another, the accelerated flow of water produced from the forward hydrodynamic shapes increases the effectiveness of the trailing hydrodynamic shapes through serial amplification of the flow of water over those shapes.

2. Description of Prior Art

Man has long sought means to propel through water with greater comfort, effectiveness, efficiency and speed. Market studies rate competitive and recreational swimming/scuba diving/snorkeling as some of the most popular exercise activities in the US. Swimming along with personal exploration of shallow and deep-sea life environments have traditionally used frog-like swim fins in a paddle-like manner with different relief schemes to lighten the work involved. Merriam-Webster Dictionary defines a swim fin: a flat rubber shoe with the front expanded into a paddle used in skin diving. This definition might better read in broad patent terminology as a means of securing the wearer's foot, generally a foot pocket, to a means of propulsion in the water, generally a blade functioning as a paddle.

Many swim fins in the past have made claims about using a "fish" based system of propulsion for their propulsion strategy. The majority of the exterior shape of a fish is involved with the fish's system of propulsion, and yet earlier conventional swim fins have seldom born any resemblance to the "exterior shape of a fish". Without using a structure related to the shape of a fish, it is difficult to follow the logic of the claim of "fish" based propulsion. There are two notable examples of "fish" propulsion systems based on the propulsion structure found in the best swimming fish, and they are found in U.S. Pat. No. 6,375,531 and U.S. Pat. No. 6,893,307, both authored by this inventor.

Both of these patents use a planar blade which is similar in function to the stiff forward part of the body of a fish (the rigid forebody) and flexible second part of the body of a fish (the flexible afterbody). The rigid forebody causes water to start flowing when it is moved through the water and the flexible afterbody causes the shaped flow of water over a effective hydrodynamic airfoil similar in shape to the fluke (tail fin) of a whale or caudal fin of a fish when it is placed at a proper angle of attack (self-regulated pitch). This flowing water over the tail fin produces "lift" as additional propulsion without any extra effort from the swimmer/diver.

U.S. Pat. No. 6,375,531, utilizes fish-derived shapes and their hydrodynamic propulsion wherein a swimmer's foot pocket is located on the stiff part of the planar blade of the swim fin beginning around the middle of the foot and extending about six inches beyond the foot (the rigid forebody). Some sort of lengthy stiff portion is common in most swim fins and this extra length increases the amount of work necessary to move the swim fin through the water because of the physics involved in moving weight at a distance involving centrifugal force due to the length of the stiff section. The extra length increases the overall length of the swim fin (usually adding to the cost of manufacturing the swim fin and the difficulty of storage and traveling with a longer swim fin).

Pending patent Ser. No. 10/060,142 teaches a first part of the swim fin, a stiff portion of the planar blade (the rigid forebody), attached to a foot pocket with side scoops used to channel water. The side scoops are not hydrodynamic airfoils. The side scoops do allow for shorter swim fins to be more effective and reduce manufacturing costs while improving storage and travel requirements.

There are earlier patents teaching the use of multiple hydrodynamic airfoils in parallel but they are not following one another in a series. For example, U.S. Pat. No. 5,536,190 and U.S. Pat. No. 4,944,703 teach multiple hydrodynamic airfoils. The airfoils in these patents are parallel in alignment, and hinged without providing self-regulating pitch to the flow of water over the foils making them ineffective by allowing the airfoils to pivot instead of causing useful lift. Since they are not spaced to follow one another, there is no opportunity for an accelerated flow of water over one airfoil to improve the performance of airfoils following in series (serial amplification).

U.S. Pat. No. 6,183,327 teaches a swim fin relating to a hydrodynamic form apparently similar to the tail fin of a whale. The form taught in this patent has several differences of serious consequence differing from a true whale's tail fin. A whale's tail fin reveals an airfoil shape when seen as a cross-section. When the cross-section is taken from the projected perpendicular line oriented to the curve of the leading edge of the whale's tail fin, it is clear that the airfoil changes its orientation to follow the leading edge. By the time it is taken from the distal edge of the tail fin, it is actually facing the side of the tail fin instead of facing the front of the tail fin. U.S. Pat. No. 6,183,327 teaches of an airfoil shape that continuously faces the front of the fin through the tail fin. This would create vortices that are contradictory to the ones found in a whale's tail fin which dramatically reduces vortices on each distal end of the whale's tail fin instead of increasing them as is the case taught in this patent. More importantly, this patent does not teach a method or apparatus for creating a flow of water over the airfoil shape at a proper angle of attack (self-regulating pitch). Without this flow of water over the hydrodynamic airfoil shape, no lift is produced. Simply waving the taught swim fin form in the water will not create any lift because the pitch would not be at the right angle of attack to the flow of water. Without facilitating a flow of water at the proper pitch, there is no useful "lift" produced to aid in propulsion.

U.S. Pat. No. 5,041,039 teaches an amphibious shoe that allows for connection of a diving flipper for use in swimming. This patent does not deal with hydrodynamic shapes to create lift to aid in propulsion. In a similar manner, International Patent WO 01/85266A2 (international publication number which is also the recently issued U.S. Pat. No. 6,620,008) discloses a swim fin with a frontal blade portion having a pair of inflexible side blade portions. This patent does not teach the use of a flexible blade or any hydrodynamic airfoil shapes used to create "lift" to aid in propulsion.

Another form of swimming shoe is taught in U.S. Pat. No. 3,107,372. Here we find another set of stiff blades meant to act as a paddle in the water. This patent does not have a flexible blade, or any hydrodynamic "airfoil" shapes used to create "lift".

In water, two types of propulsion are possible for swimmers. "Drag" propulsion and "Lift" propulsion. Paddles (most swim fins fall into this category) create propulsion by creating a void in the water into which the water flows. This flowing water pulls the paddle with it into the void. This is "drag" propulsion (the water flowing around the sides of the paddle "drag" the paddle forward into the void).

Certain shapes, most notably airfoil shapes, cause the water to flow more quickly over one surface than flows over the opposite surface producing a negative pressure. This negative pressure, called "lift", causes the swim fin to move in that direction. The most efficient way of moving through water (and through light fluids such as air) is through "lift". The great advantage of using lift occurs when the lifting forces passively work by simply holding an airfoil in a moving stream of water at the proper angle of attack with the negative pressures creating proper force vectors. The latest scientific analysis of these forces created by airfoils also includes descriptions of the vortices produced by the swirling water after leaving the airfoil. The proper angle of attack is generally thought to be about 15 to 20 degrees above or below the flow of fluid.

Numerous articles dealing with the science concerning this issue have issued within the last few years. Many of the articles written by Professor Walker at the University of Southern Maine deal with the efficiencies of rowing (the use of paddles for propulsion) versus "flapping" (the use of airfoils for propulsion) in water based upon studies of fish in nature. In these articles, the conclusion was that the proper use of airfoils was always more efficient that using paddles at every speed. Relevant printed content of the sites is included with this patent application:

(Rowing and Flapping at Low Re—Jeffrey A. Walker—American Zoologist, in press) (Printed from the internet on Nov. 2, 2003 for inclusion as documentation.)

(Mechanical performance of aquatic rowing and flying—Jeffrey A. Walker* and Mark W. Westneat—Royal Society—doi 10.1098/rspb.2000.1224) (Printed from the internet on Nov. 2, 2003 for inclusion as documentation.)

(The image describes the OPTIMAL FLAPPING WING CYCLE (with best propulsive efficiency), and below, the cycle of a caudal (movement of a dolphin flipper). (Printed from the internet on Nov. 2, 2003 for inclusion as documentation.)

(bionic analysis: MOVEMENT OF A DOLPHIN FLIPPER —>PROPULSIVE HYDROFOIL). (Printed from the internet on Nov. 2, 2003 for inclusion as documentation.)

BRIEF SUMMARY OF THE INVENTION

The present invention provides improvement of swim fins and the like by providing a MULTIPLE-SERIAL-HYDROFOIL swim fin. MULTIPLE-SERIAL-HYDROFOIL swim fins are generally dissimilar to those found in nature although they are directly adapted from natural designs found in fish and whales to provide a direct means by which a diver or swimmer (user) can propel himself/herself through the water.

At present, three embodiments of the MULTIPLE-SERIAL-HYDROFOIL swim fin are contemplated: a single unit MULTIPLE-SERIAL-HYDROFOIL swim fin, a MULTIPLE-SERIAL-HYDROFOIL swim fin where all of the components of the MULTIPLE-SERIAL-HYDROFOIL swim fin are reuseably releasably attached for easier manufacturing, modular use, ease of transportation and ease of storage. A third embodiment has a combination of fixed embodiments of the present invention incorporate multiple hydrofoils placed at an interval to increase the speed of the flow of water over the following airfoils thus enhancing the propulsion performance of the swim fins in water without increasing the effort by the user. Alternatively, the hydrofoils may be shaped similar to a whale's tail described earlier to help decrease unwanted side vortices while increasing beneficial reverse Von Karmen street vortices contributing to increased thrust and propulsion performance. Additionally, an attachable foot pocket enhances and improves the manufacturing costs and customer comfort by allowing a practical manufacturing method of a wider range of various sizes with both left and right foot variations instead of the few one-shape-fits-both-left-and-right-foot versions presently used in the industry. These multiple sized attachable foot pockets could also be made to adapt to wide and narrow feet or diving boots. They could also be made of materials of various stiffness and flexibility to adapt to different diving and swimming styles and needs.

Amongst several advantages provided by the MULTIPLE-SERIAL-HYDROFOIL swim fins set forth herein, novel means are provided by which water may be used for propulsion using reverse Von Karmen street vortices with a decrease in side vortices disturbance created by these swim fins. Undulation of the fins also provides propulsion with less effort than previous designs found in prior art. Vortices generated by the movement of the swim fins through the water may complement the operation of the swim fins. Attachable foot pockets may complement customer needs for performance, different foot sizes, and comfort.

The incorporation of designs found commonly in nature from fish and whales is adapted through compliant geometry for specific thermal plastic materials exhibiting superior Bay Shore rebound characteristics, high tear strength, high modulus numbers, and high tensile strength numbers with a hardness of approximately A Shore 90. The custom-designed high performance polyurethanes preferably used in this embodiment (although they could also be made from compressed rubber or other less expensive thermal plastics) offer a significant rebound force to the kicking force necessary to produce propulsion. This rebound force offers a secondary thrust produced by the rebound without effort from the user. The designs in these swim fins employ forms and functions from nature, but are not natural designs which require bone, muscle and tissue to function.

OBJECTS OF THE INVENTION

It is an object of the present invention to provide a MULTIPLE-SERIAL-HYDROFOIL swim fin.

It is another object of the present invention to provide a MULTIPLE-SERIAL-HYDROFOIL swim fin that has at least one side air foil attached to the left and right sides of a planar blade spaced at an influential distance in front of a following airfoil on each side of the tail fin of said swim fin.

It is yet another object of the present invention to provide a MULTIPLE-SERIAL-HYDROFOIL swim fin that is adjustable in its geometry by the use modular side fins.

It is yet another object of the present invention to provide swim fin designs which are as easy to use for beginners as they are for advanced swimmers.

It is yet another object of the present invention to provide swim fin designs which do not require significant strength or athletic ability to use.

It is yet another object of the present invention to provide swim fin designs which can be kicked across the water's surface without catching or stopping abruptly on the water's surface as they re-enter the water after having been raised above the surface.

It is yet another object of the present invention to provide swim fin designs which provide high levels of propulsion and low levels of drag when used at the surface as well as below the surface.

It is yet another object of the present invention to provide swim fin designs which provide high levels of propulsion and low levels of drag even when significantly short and gentle kicking strokes are used.

It is yet another object of the present invention to provide hydrofoil designs which significantly reduce outward directed vortices along their attacking surface.

It is yet another object of the present invention to provide hydrofoil designs which efficiently encourage the fluid medium along their attacking surface to flow away from their outer side edges and toward their center axis so that fluid pressure is increased along their attacking surface.

It is yet another object of the present invention to provide swim fin designs which significantly reduce the occurrence of ankle and leg fatigue.

It is yet another object of the present invention to provide a system of swim fins that may be interchangeably exchanged between similar swimming sandals.

These and other objects and advantages of the present invention will be apparent from a review of the following specification and accompanying drawings.

A BRIEF DESCRIPTION OF THE DRAWINGS

FIG. 1 is a top view of a foot in a MULTIPLE-SERIAL-HYDROFOIL swim fin with symmetrical side fins, where the symmetry is seen with the side fins that are symmetrical in size, shape, and spaced relationship when considered in with respect to the centerline, (hydrofoils) and a tail fin (symmetrical hydrofoils in this embodiment) shown above a side view of a generic graphic of a fish wherein the various portions of the fish body compare graphically in form to various portions of the MULTIPLE-SERIAL-HYDROFOIL swim fin. Section lines are shown for FIGS. 17 and 18 respectively and these lines will be discussed in more depth in the discussions of FIGS. 17 and 18.

FIG. 3 is a top view of an asymmetrical left foot embodiment of a MULTIPLE-SERIAL-HYDROFOIL swim fin illustrating a footpocket which is usable as a swimming shoe, a means of attaching a swimming shoe, permanent asymmetrical side fin airfoils, and a releasably secured tail fin (with asymmetrical hydrofoils).

FIG. 4 is a top view of an asymmetrical right foot embodiment of a MULTIPLE-SERIAL-HYDROFOIL swim fin illustrating footpocket which is usable as a swimming shoe, a means of attaching a swimming shoe, permanent asymmetrical side fin airfoils, and a releasably secured tail fin (with asymmetrical hydrofoils).

FIG. 5 is a perspective view of a footpocket that is usable as a swimming sandal revealing the bottom of the sole of said sandal.

FIG. 6 is a perspective view of an asymmetrical right foot embodiment of a MULTIPLE-SERIAL-HYDROFOIL swim fin with a footpocket that is usable as a swimming sandal, a means of attaching a swimming sandal, permanent asymmetrical side fin airfoils, and a releasably secured tail fin (with asymmetrical hydrofoils).

FIG. 7 is a perspective view of a retaining stud and retaining notch.

FIG. 8 is a cutaway cross-sectioned view of the retaining stud and the retaining notch in the sole reinforcement portion of the footpocket that is usable as a swimming sandal sole.

FIG. 9 is a perspective view in dashed lines of the sole of the swimming sandal held by the sole retaining catch illustrated in solid lines.

Figures 10, 11:
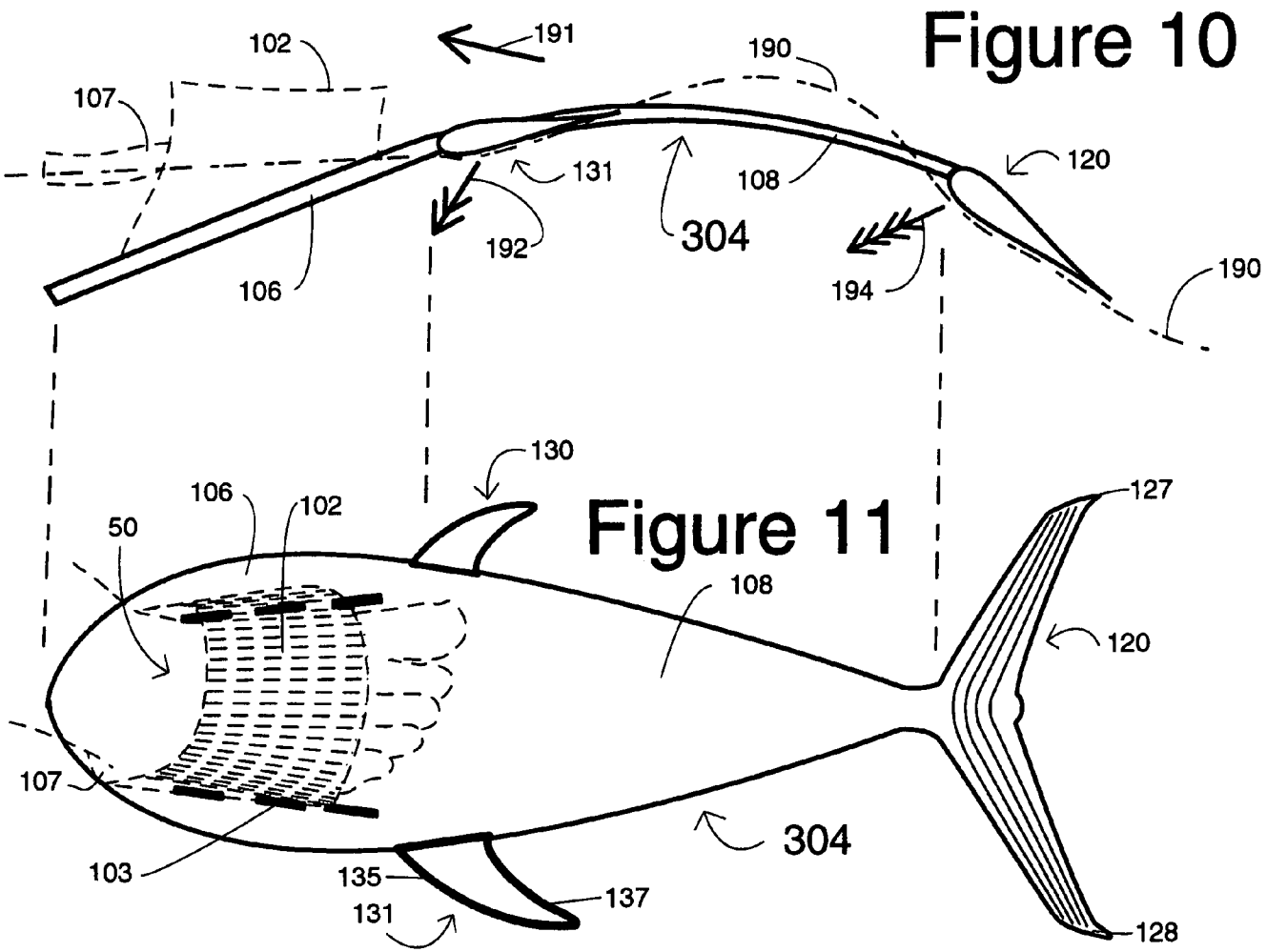
FIG. 10 is a side view of a MULTIPLE-SERIAL-HYDROFOIL swim fin illustrating movement through the water and graphically illustrating the flow of water over the serial hydrofoils of the side fin and tail fin with the thrust forces generated by negative pressure for the respective hydrofoils and the swimming sandal is shown in dashed lines.

FIG. 11 is a top view of a MULTIPLE-SERIAL-HYDROFOIL swim fin with a permanent left side fin, a asymmetrical permanent right side fin, and a permanent tail fin with symmetrical hydrofoils and an attachable foot pocket with a means of attaching the attachable foot pocket in a reusable detachable manner. The two dashed lines between FIG. 10 and FIG. 11 are used to reference the two figures respectively.

Figures 12, 13, 14, 15, 16, 17, 18:
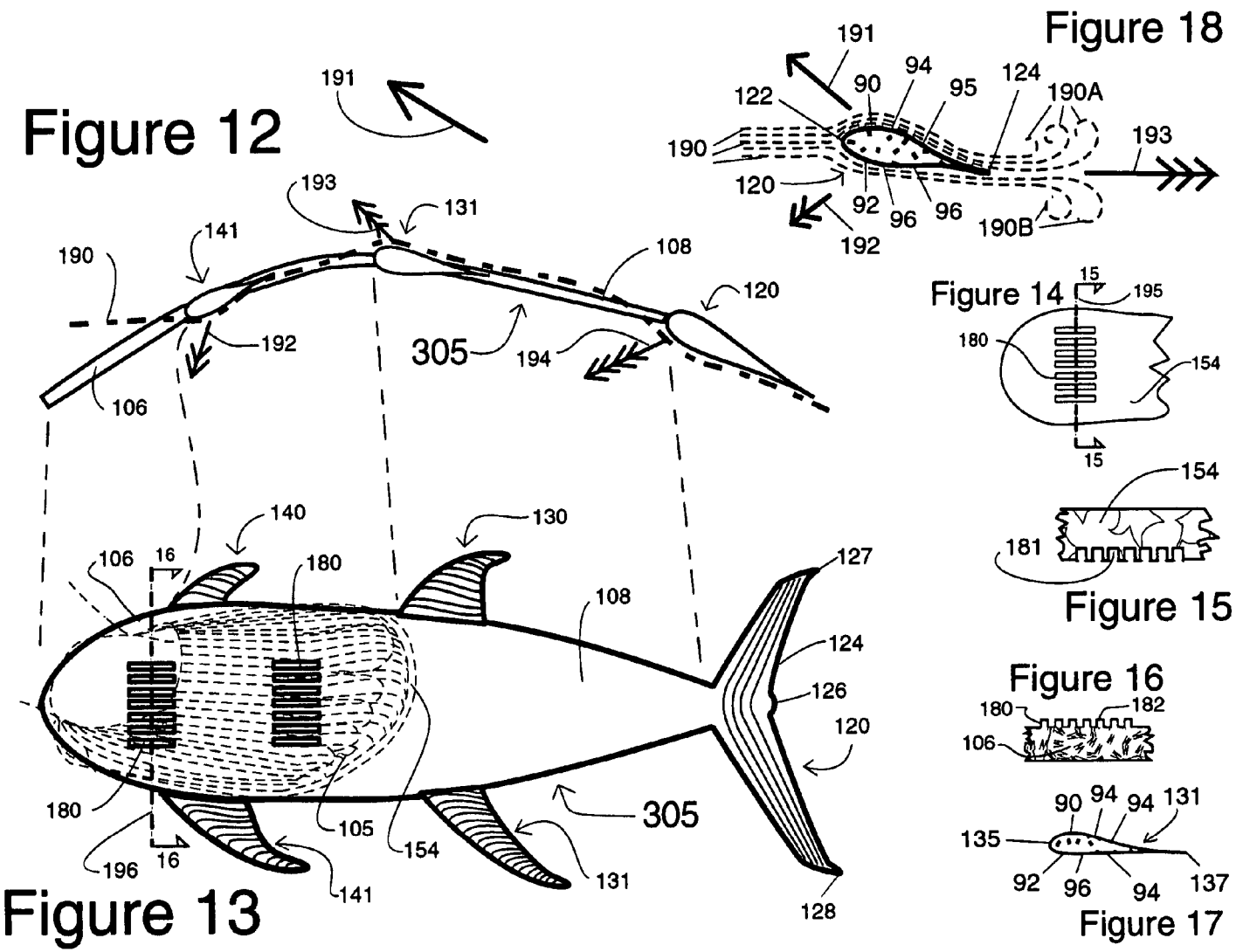

FIG. 12 is a side view of a MULTIPLE-SERIAL-HYDROFOIL swim fin illustrating movement through the water and graphically illustrating the flow of water over the serial hydrofoils of the second and first side fins and tail fin with the thrust forces generated by negative pressure shown for the respective hydrofoils.

FIG. 13 is a top view of a MULTIPLE-SERIAL-HYDROFOIL swim fin with first and second permanent left side fins, asymmetrical first and second permanent right side fins, and a permanent tail fin with asymmetrical hydrofoils. A swimming shoe is shown in dashed lines with a means of releasably securing the swimming. The two dashed lines between FIG. 12 and FIG. 13 are used to reference the two figures respectively.

FIG. 14 is a bottom view cutaway of the sole of the footpocket that is usuable as the swimming shoe found in FIG. 13 with a dashed line used as a section line for the cutaway cross-section view of FIG. 15.

FIG. 15 is a cutaway cross-sectioned view of the sole of the swimming shoe found in FIGS. 13 and 14 illustrating the use of retaining recesses in the sole.

FIG. 16 is a cutaway cross-sectioned drawing of the rigid forebody of the planar blade of the MULTIPLE-SERIAL-HYDROFOIL swim fin in FIG. 13 illustrating raised securing ribs.

Figure 1:
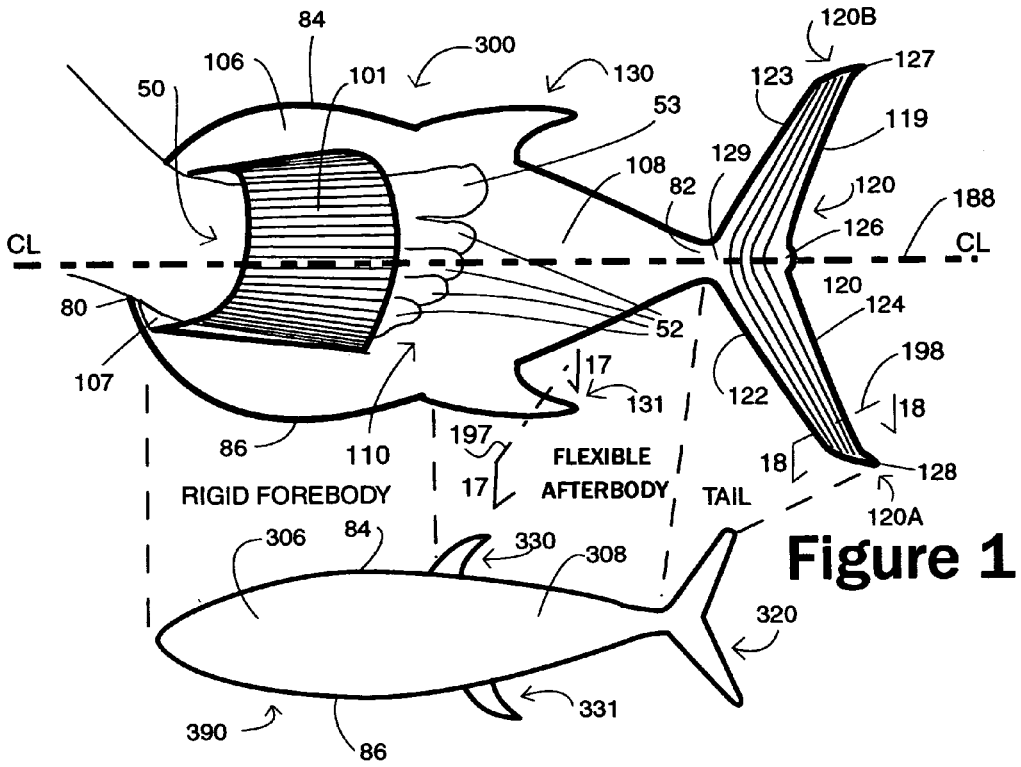

FIG. 17 is a cross-section view taken from dashed line 197 in FIG. 1. This cross-section view illustrates the asymmetrical airfoil shape used in this embodiment of a side fin.

FIG. 18 is a cross-section view taken from the dashed line 198 in FIG. 1. It illustrates the more symmetrical hydrofoil (top to bottom) of the tail fin in this embodiment. The dashed lines in this drawing graphically illustrate the flow of water over the surface of the hydrofoil illustrating the vortices created in reverse Von Karmen street vortices.

Figure 19:
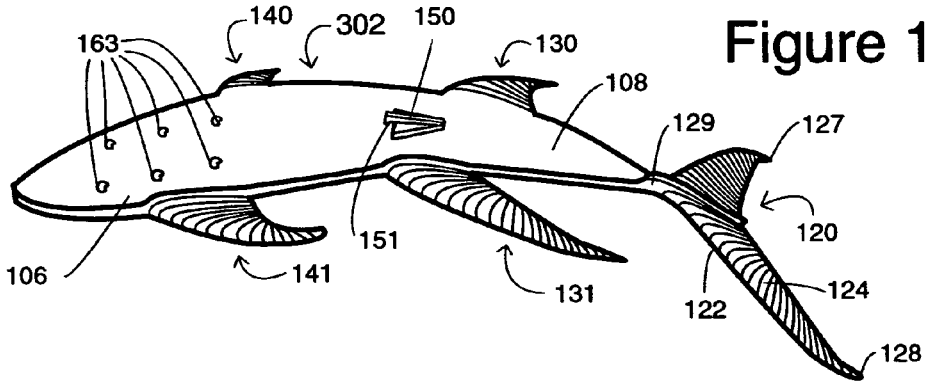

FIG. 19 is a perspective view of the MULTIPLE-SERIAL-HYDROFOIL swim fin made of softer materials to allow more flex in the relationships between the serial hydrofoils.

Figure 20:
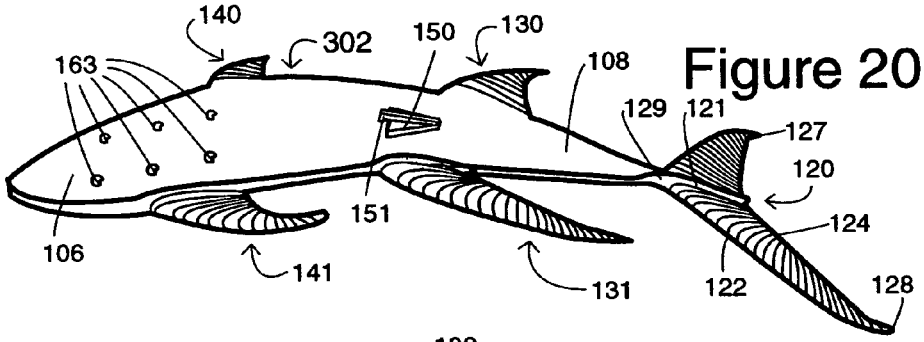

FIG. 20 is a perspective view of the MULTIPLE-SERIAL-HYDROFOIL swim fin made of stiffer materials to allow less flex in the relationships between the serial hydrofoils.

Figure 21:
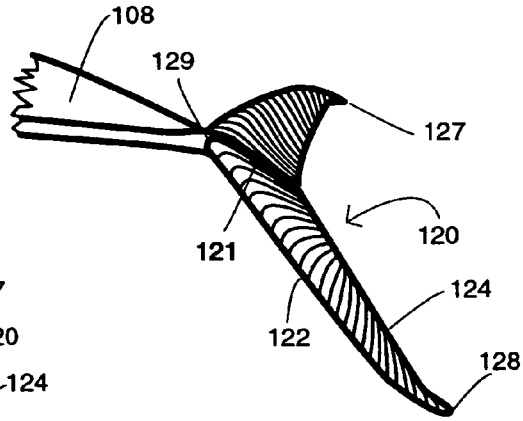

FIG. 21 is a perspective view of the flexible afterbody of the planar blade and the tail fin of a MULTIPLE-SERIAL-HYDROFOIL swim fin which is made of materials with a higher modulus to allow more flex.

Figure 22:
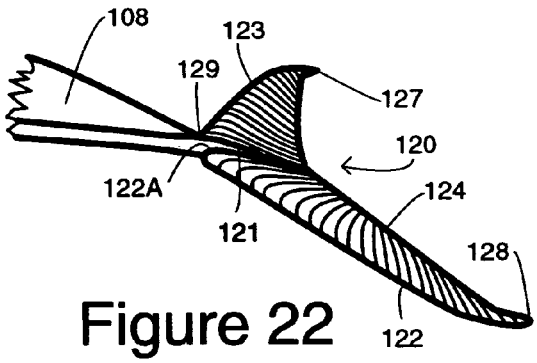

FIG. 22 is a perspective view of the flexible afterbody of the planar blade and the tail fin of a MULTIPLE-SERIAL-HYDROFOIL swim fin made of softer materials to allow less flex but employ an extended leading edge to facilitate proper pivoting.

REFERENCE NUMERALS IN DRAWINGS

50—Foot
52—Toes
53—Big toe
80—First end of planar blade
82—Second end of planar blade
84—left side of the planar blade.
86—Right side of the planar blade
90—$1^{st}$ side upper surface
92—$1^{st}$ side bottom surface
94—Lifting surface
95—$2^{nd}$ side upper surface
96—Pressure surface
97—$2^{nd}$ side bottom surface
101—Foot pocket
102—Releasably secured foot pocket
103—Means of attachment for foot pocket
104—The means of attachment for swimming shoe or sandal
105—Swimming shoe 1
106—Rigid forebody portion of the planar blade
107—Means of securing heel of foot into foot pocket
108—Flexible afterbody portion of the planar blade
109—Semi-flexible portion of the planar blade
110—Planar blade
111—Means of securing heel of foot into swimming sandal
112—Swimming sandal
119—Trailing edge of the left side of tail fin
120—Tail fin
120A—right side airfoil portion of the tail fin
120B—Left side airfoil portion of the tail fin
121—Optimum pivot point for tail fin 22—Leading edge of the right side of tail fin
122A—Leading edge wrap-around
123—Leading edge of the left side of tail fin
124—Trailing edge of the right side of tail fin
125—Means of connecting the tail fin
126—Center knob of tail fin
127—Distal end of left side of tail fin
128—Distal end of right side of tail fin
129—Connecting portion for tail fin
130—Left side fin
131—right side fin
132—left side fin means of attachment
133—right side fin means of attachment
134—left side fin leading edge
135—right side fin leading edge
136—left side fin distal end
137—right side fin distal end
138—left side fin trailing edge
139—right side fin trailing edge
140—Second left side fin
141—Second right side fin
144—Second left side fin leading edge
145—Second right side fin leading edge
146—Second left side fin distal end
147—Second right side fin distal end
148—Second left side fin trailing edge
149—Second right side fin trailing edge
150—Sole retaining system
151—Sole retaining system catch
154—Sole of swimming shoe
156—Sole of swimming sandal
157—Sole reinforcement
158—Catch
161—Recessed catch
162—Retaining notch
163—Securing stud
180—Raised securing ribs
181—Retaining recesses
182—Top surface of raised securing ribs
188—Center line
189—Dissection line for FIG. 8
190—Dashed line a simplified representation of the flow of water
190A—Reverse Von Karmen Street vortices above the tail fin
190B—Reverse Von Karmen Street vortices below the tail fin
191—Single arrow showing the movement of the swim fin
192—Double arrow showing the force vector from negative pressure on the side fin
193—Triple arrow showing force vector from the negative pressure on the second side fin
194—Quadruple arrow showing force vector from the negative pressure on the tail fin
195—Section line for FIG. 13
196—Section line for FIG. 14
197—Section line for FIG. 17
198—Section line for FIG. 18
300—MULTIPLE-SERIAL-HYDROFOIL swim fin embodiment with fixed foot pocket, side fins, and tail fin
301—MULTIPLE-SERIAL-HYDROFOIL swim fin embodiment with attachable foot pocket, and releasable reattach-able side fins and tail fin
302—MULTIPLE-SERIAL-HYDROFOIL swim fin right foot embodiment with two left side fins, two right side fins and a releasable reattach-able tail fin
303—MULTIPLE-SERIAL-HYDROFOIL swim fin left foot embodiment with two left side fins, two right side fins and a releasable reattach-able tail fin
304—MULTIPLE-SERIAL-HYDROFOIL swim fin embodiment with a means of attachment for a swimming sandal, asymmetrical side fins, and a symmetrical tail fin

305—MULTIPLE-SERIAL-HYDROFOIL swim fin embodiment with raised securing ribs, two left side fins that are asymmetrical to two right side fins, and an asymmetrical tail fin

306—Rigid forebody of generic fish graphic

308—Flexible afterbody of generic fish graphic

320—Caudle fin (tail fin) of generic fish graphic

330—Dorsal side fin of generic fish graphic

331—Pelvic side fin of generic fish graphic

390—Generic fish graphic

DESCRIPTION OF THE PREFERRED EMODIMENT(S)

Selected shapes enhance the effectiveness of foot fins because certain shapes, most notably airfoil shapes, cause the fluid (water) to flow more quickly over one surface than it flows over the opposite surface producing a negative pressure hereafter referred to as "lift". (Ref. Bernoulli effect). This negative pressure causes the swim fin to move in that direction. Airplane wings (airfoil shapes) offer an example of a most efficient way of moving through water in light fluids such as air using "lift". The great advantage of using lift occurs when the lifting forces passively work by simply holding an airfoil in a moving stream of water at the proper angle of attack (pitch) with the negative pressures creating propulsive force vectors.

FIG. 18 is a cross-section view of the hydrofoil portion of the tail fin 120 which the dashed line 198 in FIG. 1 acts as the section line and describes some of the known aspects of this airfoil. The cross-section of the tail fin 120 (a symmetrical airfoil shape in this embodiment) has a first side upper surface 90, a first side bottom surface 92, a second side upper surface 95 and a second side bottom surface 97. The airfoil increases in thickness from the leading edge 122 and between the first upper and lower surfaces 90 and 92 till being widest between the lifting surface 94 and the pressure surface 96 and then decreasing in thickness between the second upper and lower surfaces 95 and 96 respectively until it terminates at the trailing edge 124. When the tail fin 120 has the optimum pitch (an angle of attack of approximately 20 degrees off of the direction of the stream of water), the first side 90 becomes the lifting side 94 causing the second side 92 to become the pressure side 96. The flow of water represented by the dashed line 190 has to go further over the lifting surface 94. The declining size of the tail fin 120 as it goes closer to the trailing edge 124 causes the water to rush together at the trailing edge 124. The water forms vortices 190A and 190B that flow away from each other forming a phenomenon known as reverse Von Karmen street vortices. These vortices 190A and 190B cause a thrust in the water as described by the latest theories in computational fluid dynamics, illustrated by the triple arrow 193, to help push the tail fin 120 in roughly the opposite direction illustrated by the single arrow 191. This force is in the optimum desired direction for the swimmer using these tail fins as part of the MULTIPLE-SERIAL-HYDROFOIL swim fins.

A dashed section line 197 crossing the right fin 131 shows where the cross-section drawing for FIG. 17 refers. Viewing FIG. 17 reveals a cross-section drawing of an asymmetrical airfoil in this embodiment. The asymmetrical formation allows only the first side 90 to be an effective lifting side 94 and allows only the second side 92 to be an effective pressure side 96. The advantage of this embodiment is for thinner working airfoils. The airfoils used each airfoil embodiment for side fins 130, 131, 140, 141 and the tail fin 120 have the possibility of being symmetrical or asymmetrical as needed for producing optimum water flow, lift and optimum forward propulsion for the swimmer.

Hydrodynamic airfoils properly placed in serial relationship offer increased efficiency beyond the simple lift propulsion just described of single airfoils. Properly placed hydrofoils on boats (along with certain dorsal and pelvic fins found on the best swimming whales and fishes) demonstrate this increased efficiency. At present, no swim fins use this highly efficient form of locomotion through water.

FIG. 1 shows a top view of a MULTIPLE-SERIAL-HYDROFOIL swim fin 300 juxtaposed against a side view of a generic fish graphic 390. The MULTIPLE-SERIAL-HYDROFOIL swim fin forms a foot pocket 101 permanently attached to the proximity of the first end 80 of the more rigid forebody portion 106 of the planar blade 110 and further attached to the more flexible afterbody portion 108 of the second end 82 of the planar blade 110 with the tail fin 120 extending from the proximity of the second end 82. A left side fin 130 and a right side fin 131 are positioned on the left side 84 and right side 86 of the planar blade 110. A foot 50 is illustrated in the foot pocket 101. The rigid forebody 106 is relatively rigid, and the flexible afterbody 108 is relatively flexible. A center line 188 extends from the first end 80 to through the second end 82 of the planar blade 110 with the tail fin and is equidistant from the left side 84 of the planar blade 110 and the right side 86 of the planar blade 110. The fixed foot pocket 101 attached to the rigid forebody 106 compares strongly to the rigid forebody portion 306 of a generic fish 390 in which the general purpose of both portions is to cause water to begin flowing. The flexible portion 108 of the planar blade 110 compares strongly to the flexible afterbody of the generic fish 309 in which the general purpose of both is to shape the flow of water and respectively hold the tail fin 120 and the caudal fin 320 at a proper pitch to the flow of water. This allows the swim fin 300 and the graphic fish 390 to use the tail fin 120 and caudal fin 320 to produce a negative pressure (lift) in the correct direction converting this pressure into forward thrust.

The tail fin 120 is composed of two air foil portions, the right side airfoil portion 120A and the left side airfoil portion 120B. Both of these airfoils act as superior hydrofoils when used in water and work in serial amplification with the right side fins and left side fins respectively.

A means of retaining the heel 107 of the foot 50 to the foot pocket 101 has many embodiments. One embodiment has an elastic strap. Another embodiment has two straps with a buckle adjusting and holding the two straps together. Another embodiment has an elastic pocket for the heel. Other embodiments may use straps with hooks and loops. All alternate means of securing the foot 50 to the swim fin 300 in these teachings are for illustrative purposes only, as one of average skill in this art may adapt alternate ways of securing the foot 50 to the swim fin 300 disclosed herein, and such alternate means of securement are intended to be incorporated within the scope of this disclosure, and the following claims.

In this embodiment, the swim fin 300 has a symmetrical set of side fins and is a mirror image of itself on both sides of the centerline 188. A left side fin 130 and a right side fin 131 are mirror images of each other and strongly compare to the dorsal fin 330 and pelvic fin 331 of the generic fish body 390. In this simplified embodiment, they function to channel the flow of water towards the centerline 188 and over the center portion of the tail fin 120. With the symmetry of swim fin 300, each of the different embodiments of the foot pocket 101 (with the different embodiments of the foot pocket 101 as the releasably secured foot pocket 102 of FIG. 2, the swimming shoe 105 of FIGS. 3 and 4, and the swimming sandal of FIG. 5) can be adapted to secure the users foot 50 to the swim fin 300.

Manufacturing the "fixed" foot pocket 101 separately and then permanently attaching it to the swim fin 300, allows for larger variations in the foot pockets providing better foot support, larger use of different materials, different sizes, and comfort while offering reduced costs in manufacturing. Manufacturing the planar blade 110, the side fins 130 and 131, and the tail fin 120 as a mono construction allows for a much simpler two-piece mold that is smaller than normally found in use for producing commercial swim fins. This smaller, easier to use, mold reduces manufacturing costs and allows for more variety in products.

The footpocket 101 and a means of retaining the heel (possibly a retaining strap) 107 are assembled with the rest of the swim fin later by a snap joint or other means of attachment. This approach allows different foot pocket sizes and foot pocket variations for the left and right foot for assembly. The various embodiments for foot pockets (as describe above) facilitate a better and more comfortable fit for each foot; enable "mass customization" including instep supports, padding, insulation, and full foot pockets with heel support and other customer-desired features. Possible embodiments could include side scoops, however, the foot pocket 101 would have to incorporate the side scoops (similar to those taught in U.S. Pat. No. 6,893,307) as part of the foot pocket 101 because each embodiment of the foot pocket 101 would be uniquely left or right foot in orientation. The separate production of a foot pocket 101 also substantially reduces mold costs since the various foot pocket molds cost substantially less than trying to produce the entire swim fin 300 in one mold.

The embodiment of the swim fin 300 in FIG. 1 functions in a substantially similar manner to swim fins described in U.S. Pat. No. 6,893,307 with a major difference. The embodiment of the swim fin 300 in FIG. 1 does not have side scoops as is described in U.S. Pat. No. 6,893,307 but does have a planar blade 110 with an extra wide more rigid forebody 106 between the ankle and the toes offering similar advantages of the side scoops while costing less for manufacturing.

The tail fin 120 has two airfoils 120A and 120B co-joined at the center and producing a small raised area, the center knob 126 of the tail fin 120, in this embodiment. Each side of the tail fin 120 has extruded airfoils as seen in the cross section drawing in FIG. 18 that begin at the leading edge 122 and 123 respectively and remain basically perpendicular to the leading edges 122 and 123 respectively until reaching the distal ends 127 and 128 respectively. By having the airfoils slant back towards the centerline (or curve back in other embodiments), the water is focused towards the centerline 188 leaving less water to cause side vortices and drag near the distal ends 127 and 128 respectively. The airfoils terminate at the trailing edges 124 and 119 respectively and they get proportionately larger as the distance between the leading edges 122 and 123 and the trailing edges 124 and 119 are larger respectively for 120A and 120B. They also get proportionately smaller as the distance between the leading edge 122 and the trailing edge 124 is smaller. They also get proportionately smaller as the distance between the leading edge 123 and the trailing edge 119 is smaller. The tail fin 120 connects to the flexible afterbody 108 of the planar blade 110 in the proximity of the second end 82 by the connecting portion of the tail fin 129.

Figure 2:
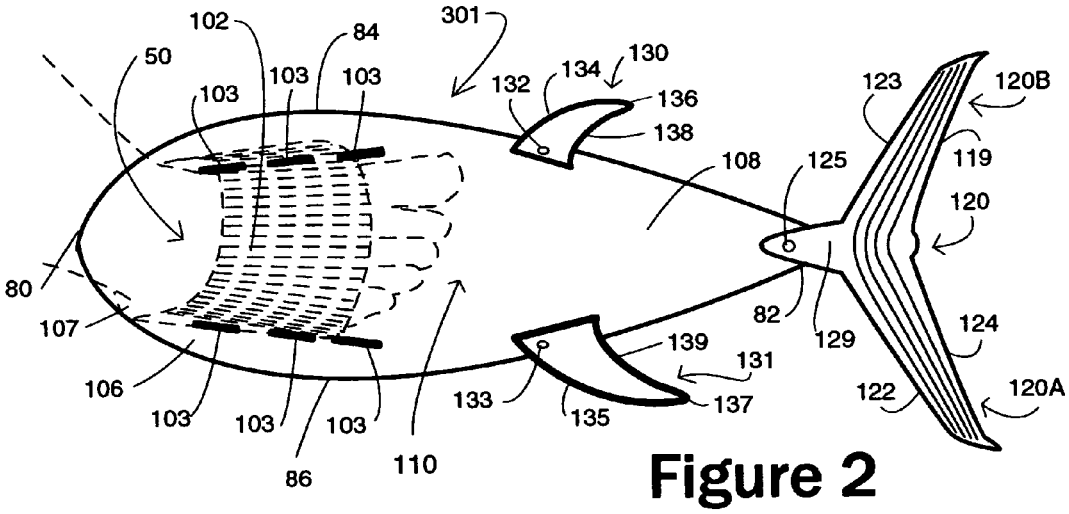
FIG. 2 is a top view of a MULTIPLE-SERIAL-HYDROFOIL swim fin illustrating an attachable foot pocket, a means of attaching a foot pocket, releasably secured side fins, and a releasably secured tail fin (with symmetrical hydrofoils).

FIG. 2 is a top view of a swim fin 301 with a means of attaching a releasably secured foot pocket 102, releasably secured side fins 130 and 131, and a releasably secured tail fin 120. By using releasably secured foot pockets 102, side fins 130 and 131, and tail fin 120, many alternative embodiments for "mass customization" possibilities exist. As mentioned earlier, the foot pocket 102 could have alternative embodiments that allow for different sizes, materials, instep supports, insulation, padding which are designed to different ways and for different uses. Each releasably secured part of the swim fin 301 may affect performance when substituted by another part creating a new embodiment. For example, a larger version of the pelvic side fin 131 may reduce Tendonitis for swimmers. By using larger side fins for 130 and 131 along with a larger tail fin 120, a swimmer may gain more speed and train the muscles better for cross training or normal swimming. The means of attachment for the left side fin 132 and right side fin 133, may take the form of a relatively permanent connection such as a bolt and nut or a quick-change connector such as a hook and loop type fastener. The tail fin connector 125 could also have quick-release or more permanent connection embodiments. The connecting parts must be able to withstand vibrations and any normal forces occurring during swimming and diving. These side fin means of attachment 132 and 133 along with the tail fin means of attachment 125 are illustrative only, as one of average skill in this art may adapt other known means of attachment, and such alternate means of attachment are intended to be incorporated into the scope of this disclosure and following claims.

The left and right side fins, 130 and 131, have leading edges, 134 and 135, trailing edges, 138 and 139, and distal points, 136 and 137, respectively. These side fins, 130 and 131, are always meant to shape water, but they can produce hydrodynamic "lift" propulsion caused by an airfoil profile, as is discussed in FIG. 17, when water flows over them.

FIG. 3 is a top view of an asymmetrical left foot swim fin 303. In this embodiment, there is a first pelvic fin 131 and a second pelvic fin 141 which are larger than the corresponding first left fin 130 and second right fin 140. A swimming shoe 105 is shown in a dashed line with its sole 154 and a foot 50, also drawn in a dashed line. A means of attaching the swimming shoe 104 is part of the rigid forebody 106 of a planar blade 110 in this embodiment. This means of attachment 104 may have many possible embodiments. Possible embodiments include releasable snaps, "hook and loop" systems, and other means of attachment that are reusable after detachment. All alternative embodiments for a means of attachment are for illustrative purpose only as one of average skill in this art may adapt other known means of attachment, and such alternate means of attachment are intended to be incorporated into the scope of this disclosure and following claims.

A triangular shape, located at the forward portion of the swimming sole 154, includes the sole retaining system 150 along with the sole retaining catch 151. This sole retaining system 150 helps to align the foot and attach the front part of the swimming sole 154 to the swim fin 303.

The tail fin 120 has two co-joined airfoils. Notice that in this embodiment the airfoil ending at distal point 128 is longer than the airfoil ending at distal point 127. In this embodiment, the longer airfoil on the tail fin 120 corresponds to the longer pelvic fins 131 and 141. In this embodiment, the tail fin has a configuration allowing it to detach and reattach in a useable manner. Although the second left fin 140 and the second right fin 141 are asymmetrical, they both have a leading edge 144 and 145, and distal points 146 and 147, and a trailing edge 148 and 149 respectively.

FIG. 4 is a top view of an asymmetrical embodiment of a right foot oriented swim fin illustrating a means of attaching a swimming shoe, permanent side fin airfoils, and a releasably secured tail fin. This embodiment of swim fin 302 is the mirror image of the embodiment of swim fin 303 in FIG. 3. Note that the centerline 188 for the swim fin 303 illustrates asymmetrical parts created to better accommodate the difference between the right and left foot swimming shoes 105 and the swimming styles of the swimmer.

FIG. 5 is a perspective view of a swimming sandal 110 revealing the bottom of the swimming sandal sole 156. The sandal 112 is seen with the sandal sole 156 showing below and has a means of attaching the heel 111.

The recessed catches 161 offer another means of attaching swimming sandals 110 (and other embodiments of swimming footwear) to a swim fin 302 (and other embodiments of swim fins). The dashed line 189 refers to the cutaway cross-sectioned drawing for FIG. 8. In FIG. 6, the swim fin 302 has securing studs 163 that align with the recessed catches. The securing stud 163, as seen in a close-up perspective drawing in FIG. 7, has a retaining notch 162. FIG. 8 shows the retaining notch 162 caught on the catch 158 of the sole reinforcement 157 that has the recessed catch 161. The sole reinforcement 157 is part of the sole 156 of the swimming sandal 110.

FIG. 9 reveals a closer look at the sole retaining system catch 151 and sole retaining system 150 as they hold the sole 156 from moving. The retaining notch 162 is designed to pull away from the catch 158 thus allowing the removal of the securing studs 163 from the recessed catch 161. The big toe 53 and the little toes 52 offer a sense of scale to the drawing. The sole retaining system 150 and catch 151 serve to hold the sole 156 in place to prevent the securing studs 163 and their retaining notch 162 attached to the rigid forebody 106 of the planar blade 110 from releasing the from catch 158 of the sole reinforcement 157.

FIG. 10 is a side view of a swim fin 304 moving in a direction shown by a single arrow 191 through the water and illustrates graphically the flow of water (a dashed line) 190 with the thrust forces created by a right side fin 131 and the tail fin 120 in series. The flow of water 190 under the airfoil shaped side fin 131 causes the water to flow faster over that surface creating a negative pressure (lift) representing a force vector with the double arrow 192. FIG. 18 illustrates how the water flows 190 over the airfoil cross-section taken from line 18 in FIG. 11. The water flow 190 creates a lifting side 94 of the first side 90 and a pressure side 96 of the second side 92 because the water flow 190 must go further (shown by the double arrow 192). The declining size of the airfoil near the trailing edge 124 allows the water to rush together creating "reverse Von Karmen Street vortices" 190A and 190B (the dashed line swirling away from the trailing edge 124). This causes the water to increase in speed and flow in a thrust vector represented by the triple arrow 193. In FIG. 18, a cutaway cross-section drawing taken from the dashed line 18 over the tail fin 120 in FIG. 11 reveals a symmetrical airfoil. This symmetry allows the first side 90 to be the lifting side 94 at one pitch while allowing the second side 92 to be the lifting side 94 at a different pitch. When the second side 92 becomes the lifting side 94, the first side 90 becomes the pressure side 96. This symmetrical design allows lift to work in both the up and down stroke in swimming.

With a proper distance and relationship between the side fin 131 and the tail fin 120, the increased speed of the flow of water 190 directed at the co-joined airfoils (the tail fin 120) at a proper angle of attack creates increased lift in the tail fin 120 too. The vector for the lift of the tail fin 120, shown as the quad-arrow 194, shows how it would positively affect movement through the water in the direction of swimming. By placing the airfoils in a correct relationship with each other, the increased speed of the flow of water 190 is further increased by the tail fin 120 in serial amplification.

FIG. 11 is a top view of a swim fin 304 with a permanent left side fin 130, a permanent right side fin 131, and a permanent tail fin 120 with a means of attachment 103 with a releasably secured foot pocket 103. The foot pocket 102, the foot 50 and the heel securing means of attachment 107 (shown in dashed lines) offer a frame of reference for a possible embodiment of the swim fin 304. The left fin 130 is almost symmetrical with the right fin 131 and the tail is slightly asymmetrical in this embodiment. The means of attachment 103 may be larger than is need for a smaller foot pocket 102 to ensure that it is large enough for larger embodiments of a foot pocket 102 too.

FIG. 12 is a side view of a swim fin 305 moving in a direction shown by a single arrow 191 through the water. FIG. 12 illustrates graphically the flow of water 190 with the thrust forces created by a right side fin 131 airfoil, a second side right fin 141 and the tail fin 120 airfoil in series. The flow of water 190 under the airfoil shaped side fin 141 causes the water to flow faster over that surface creating a negative pressure (lift) represented by the double arrow 192. The flow of water 190 over the airfoil shaped first right side fin 131 causes the water to flow even faster than over the second right side fin 141. With a proper distance and relationship between the second right side fin 141 and the first right side fin 131, the increased speed of the flow of water 190 directed at the first side fin 131 at the proper angle of attack creates increased lift in the first right side fin 131. The vector for the lift of the side fin 131, shown as the tri-arrow 193, shows how it would positively affect movement through the water in the direction of swimming. With a proper distance and relationship between the side fin 131 and the tail fin 120, the increased speed of the flow of water 190 directed at the co-joined airfoils (the tail fin 120) at a proper angle of attack creates increased lift in the tail fin 120. The vector for the lift of the tail fin 120 (quad-arrow 194) shows how it would positively affect movement through the water in the direction of swimming. This serial increase in speed at each successive airfoil shape is herein called "serial amplification". The flow of water 190 is a representation of the water thrust vector of reverse von Karmen street vortices that airfoils produce in water when properly angled to the flow of water 190 (as shown in FIG. 18). This is very similar to the reverse von Karmen street vortices produced by the bodies of fish because the swim fin 305 has a set of very similar forms to a fish body and moves through the water in a very similar manner to fish.

FIG. 13 is a top view of a swim fin 305 with two permanent left side fins 130 and 140, two permanent right side fins 131 and 141, a permanent tail fin 120 and with a means of connecting a swimming shoe (a possible embodiment of the footpocket 101 as mentioned above) through a set of retaining ribs. The dashed line 16 references the cutaway cross-section drawing in FIG. 16. This cutaway cross-section drawing helps to explain the structure of the raised securing ribs 180. The top of the raised securing ribs 182 could have hooks (integral or releasably secured) used to mate with the loops in the recesses of the retaining recesses 181 seen in FIG. 14 on the bottom of the swimming shoe sole 154. These retaining recesses 181 are better explained in FIG. 15 by the cutaway cross-section drawn from the dashed reference line 15 in FIG. 14. Hooks or Loops (integral of releasably secured) at the top of the recess in the retaining recess 181 mate with the complimentary hooks or loops on the top of the raised securing ribs 180 to secure the swimming shoe sole 154 to the rigid forebody 106 of the planar blade 110 of the swim fin 305 seen in FIG. 15. Any number of airfoils could be practically placed in series, but in nature, there are seldom more than three fins in a series.

FIG. 19 shows a perspective drawing of the swim fin 302 in a flexed position as it would be from water pressure in use during swimming. The rigid forebody 106 of the planar blade 110 flexes less than the flexible portion 108. In this embodiment, the side fins 130, 131, 140, and 141 along with the tail fin connector 129 have a material composition of a flexible nature with a high modulus number to allow more flex in the geometry of the form to affect an optimum pitch during general swimming.

FIG. 20 is a perspective drawing of a swim fin 302 with stiffer side fins 130, 131, 140, 141 and the tail fin connector 129. In this embodiment, the firmer and more rigid materials affect the pitch as a function of "compliant geometry" (the influence of the internal characteristics of the materials used on the three dimensional behavior of the geometric structure of an object when forces are applied). More forces can be applied to achieve an optimum pitch making this type of embodiment best for the stronger kicks used in scuba diving and open sea rescues. The use of high performance materials also helps to regain some of the effort generated by the user when undulating the swim fins for reuse in future kicks.

FIGS. 21 and 22 are perspective drawings of a cutaway view of the swim fin 302. In the preferred embodiment, the stiffness of the tail fin connector 129 should allow the tail fin 120 to pivot at a pivot point 121. This optimum pivot point is located approximately on the centerline of the tail fin. It is approximately one quarter of the distance from the leading edge 122 to the trailing edge 124 of the tail fin 120. The side fins also preferably have the optimum pivot point approximately one quarter of the distance from the leading edges 134, 135, 144, 145 to the trailing edge 138, 139, 148, 149 for side fin 130, 131, 140 and 141 respectively.

In FIG. 22, the tail fin 120 has a leading edge 122 that has a leading edge wrap-around 122A reaching to the pivot point 121 and not connected to the tail fin connector 129. This allows easier pivoting to achieve an optimum pitch in the flow of water with less effort which is especially important when using stiffer and more rigid materials.

I claim:

1. A multiple-serial-hydrodynamic swim fin apparatus comprising:

a) a planar blade having a first end and a second end forming a rigid forebody and a flexible afterbody with a left side and a right side wherein a center line extends from the first end to the second end equidistant from the left side and the right side of the planar blade;

b) a foot pocket attached to the planar blade in the proximity of the first end and the rigid forebody of the planar blade;

c) a tail fin extending from the proximity of the second end of the planar blade where by the tail fin has a left side airfoil portion and a right side airfoil portion of the tail fin conjoined;

d) at least one left side fin whereby the left side fin is positioned on the left side of the planar blade between the first end and the second end of the planar blade wherein the side fin is an airfoil; and e) at least one right side fin whereby the right side fin is positioned on the right side of the planar blade between the first end and the second end of the planar blade wherein the side fin is an airfoil.

2. The swim fin apparatus of claim 1 wherein said foot pocket is releasably secured.

3. The swim fin apparatus of claim 1 wherein said left side fin is releasably secured.

4. The swim fin of claim 1 wherein said right side fin is releasably secured.

5. The swim fin apparatus of claim 1 wherein said tail fin is releasably secured.

6. The swim fin apparatus of claim 1 wherein said footpocket is a swimming sandal and a means of securement thereof.

7. The swim fin apparatus of claim 1 wherein said foot pocket is a swimming shoe and a means of securement thereof.

8. The swim fin apparatus of claim 1 wherein said tail fin has a leading edge wrap-around.

9. The swim fin apparatus of claim 1 wherein said planar blade has a second left side fin.

10. The swim fin apparatus of claim 1 wherein said planar blade has a second right side fin.

11. The swim fin apparatus of claim 1 wherein said left side fin and said side right fin are symmetrical positioned in relation to the center line of the planar blade and mirror images of each other.

12. The swim fin apparatus of claim 1 wherein said left side fin and said right side fin are asymmetrically positioned and asymmetrical in size and shape.

13. The swim fin apparatus of claim 1 wherein said left side airfoil portion and said right side airfoil portion of said tail fin are symmetrical in relation to the centerline and symmetrical in size and shape.

14. The swim fin apparatus of claim 1 wherein said left side airfoil portion and said right side airfoil portion of said tail fin are asymmetrical in size and shape.

15. A multiple-serial-hydrodynamic swim fin apparatus comprising:

a) a planar blade having a first end and a second end forming a rigid forebody and a flexible afterbody with a left side and a right side wherein a center line extends from the first end to the second end equidistant from the left side and the right side of the planar blade;

b) a foot pocket attached to the planar blade in the proximity of the first end and the rigid forebody of the planar blade;

c) a tail fin extending from the proximity of the second end of the planar blade where by the tail fin has a left side airfoil portion and a right side airfoil portion of the tail fin conjoined;

d) a first left side fin whereby the left side fin is positioned on the left side of the planar blade between the first end and the second end of the planar blade wherein the side fin is an airfoil;

e) a second left side fin whereby the left side fin is positioned on the left side of the planar blade between the first end and the second end of the planar blade wherein the side fin is an airfoil;

f) a first right side fin whereby the right side fin is positioned on the right side of the planar blade between the first end and the second end of the planar blade wherein the side fin is an airfoil; and g) a second right side fin whereby the right side fin is positioned on the right side of the planar blade between the first end and the second end of the planar blade wherein the side fin is an airfoil.

16. The swim fin apparatus of claim 15 wherein said wherein the foot pocket is releasably secured.

17. The swim fin apparatus of claim 15 wherein said first left side fin, said second left side fin, said first right side fin and said second right side fin are releasably secured.

18. The swim fin apparatus of claim 15 wherein said wherein the tail fin is releasably secured.

19. A multiple-serial-hydrodynamic swim fin apparatus comprising:

a) a planar blade having a first end and a second end forming a rigid forebody and a flexible afterbody with a left side and a right side wherein a center line extends from the first end to the second end equidistant from the left side and the right side of the planar blade;

b) a swimming shoe attached to the planar blade in the proximity of the first end and the rigid forebody of the planar blade;

c) a tail fin extending from the proximity of the second end of the planar blade where by the tail fin has a left side airfoil portion and a right side airfoil portion of the tail fin conjoined;

d) a first left side fin whereby the left side fin is positioned on the left side of the planar blade between the first end and the second end of the planar blade wherein the side fin is an airfoil;

e) a second left side fin whereby the left side fin is positioned on the left side of the planar blade between the first end and the second end of the planar blade wherein the side fin is airfoil;

f) a first right side fin whereby the right side fin is positioned on the right side of the planar blade between the first end and the second end of the planar blade wherein the side fin is an airfoil; and g) a second right side fin whereby the right side fin is positioned on the right side of the planar blade between the first end and the second end of the planar blade wherein the side fin is an airfoil.

20. The swim fin apparatus of claim 19 wherein said first left side fin, said second left side fin, said first right side fin, said second right side fin and said tail fin are releasably secured.

* * * * *